US008988218B2

(12) United States Patent
Guo et al.

(10) Patent No.: US 8,988,218 B2
(45) Date of Patent: Mar. 24, 2015

(54) SELF-DETECTION OF LOST DEVICE STATUS USING DEVICE-TO-DEVICE COMMUNICATIONS WITH ONE OR MORE EXPECTED NEIGHBORING DEVICES

(71) Applicant: International Business Machines Corporation, Armonk, NY (US)

(72) Inventors: Shang Q. Guo, Cortland Manor, NY (US); Canturk Isci, Secaucus, NJ (US); Jonathan Lenchner, North Salem, NY (US); Maharaj Mukherjee, Poughkeepsie, NY (US); Emmanuel Tong-Viet, Montpellier (FR)

(73) Assignee: International Business Machines Corporation, Armonk, NY (US)

( * ) Notice: Subject to any disclaimer, the term of this patent is extended or adjusted under 35 U.S.C. 154(b) by 5 days.

(21) Appl. No.: 13/856,826

(22) Filed: Apr. 4, 2013

(65) Prior Publication Data

US 2014/0300471 A1 Oct. 9, 2014

(51) Int. Cl.

| | |
|---|---|
| ***G08B 1/08*** | (2006.01) |
| ***G08B 21/02*** | (2006.01) |
| ***G08B 21/24*** | (2006.01) |
| *G08B 25/00* | (2006.01) |

(52) U.S. Cl.

CPC ..... *G08B 21/24* (2013.01); *G08B 21/0258* (2013.01); *G08B 21/0277* (2013.01); *G08B 25/009* (2013.01)

USPC ..... 340/539.32; 340/539.11; 340/539.16

(58) Field of Classification Search

USPC ..... 340/539.1, 539.11, 539.13, 539.14, 340/539.26, 531, 572.1, 10.2, 539.16, 340/539.32; 455/11.1, 436, 437, 438; 370/310.2, 312, 331

See application file for complete search history.

(56) References Cited

U.S. PATENT DOCUMENTS

| | | | | |
|---|---|---|---|---|
| 5,831,526 | A * | 11/1998 | Hansler et al. | 340/539.14 |
| 6,166,652 | A | 12/2000 | Benvenuti | |
| 6,366,201 | B1 | 4/2002 | Rosenthal | |
| 6,956,475 | B1 | 10/2005 | Hill | |

(Continued)

OTHER PUBLICATIONS

Shiraishi et al., "Indoor Location Estimation Technique using UHF band RFID," Information Networking, 2008. ICOIN 2008. International Conference on.

(Continued)

*Primary Examiner* — Van T. Trieu

(74) *Attorney, Agent, or Firm* — Ryan, Mason & Lewis, LLP

(57) ABSTRACT

Methods and apparatus are provided for self-detection of lost device status using device-to-device communications with one or more expected neighboring devices. A device can detect when the device itself is lost, by determining one or more expected neighboring devices for one or more time periods; monitoring a local environment for one or more of the expected neighboring devices using device-to-device communication; detecting when the device is lost based on device-to-device communication and whether a threshold criteria of the expected neighboring devices in proximity to the device for a given interval of time; and sending at least one relay message to notify an owner of the lost device. The threshold criteria comprises, e.g., whether a minimum number of expected neighboring devices are nearby or whether at least one fixed neighboring device is nearby. The device-to-device communications employ one or more of short range relay communications and low-power mesh communications.

9 Claims, 6 Drawing Sheets

(56) References Cited

U.S. PATENT DOCUMENTS

| | | | | |
|---|---|---|---|---|
| 7,138,915 | B2 | 11/2006 | Morito et al. | |
| 7,416,123 | B2 | 8/2008 | Saperstein | |
| 7,848,704 | B2 | 12/2010 | Smith | |
| 8,185,112 | B2 * | 5/2012 | Favre et al. | 455/436 |
| 8,660,480 | B2 * | 2/2014 | Jacobs et al. | 455/11.1 |
| 2005/0164717 | A1 * | 7/2005 | Leping | 455/458 |
| 2007/0133469 | A1 * | 6/2007 | Shin et al. | 370/331 |
| 2007/0138273 | A1 | 6/2007 | Saperstein et al. | |
| 2010/0148931 | A1 * | 6/2010 | Pappu et al. | 340/10.2 |
| 2011/0050462 | A1 | 3/2011 | LaGreca | |

OTHER PUBLICATIONS

Halberg et al., "Localisation of Forgotten items using RFID Technology," Proceedings of the 9th International Conference on Information Technology and Applications n Biomedicine, ITAB 2009, Larnaca, ~rus, Nov. 5-7, 2009.

* cited by examiner

*FIG. 2*

EXPECTED NEIGHBOR DATABASE – 200

| 210 DEVICE IDENTIFIER | 220 DAYTIME NEIGHBORS | 230 EVENING NEIGHBORS | 240 PAIRED DEVICE(S) | 250 FIXED/PORTABLE LOCATION |
|---|---|---|---|---|
| DEVICE 1 (KEYS) | DEVICES 2 AND 3 | DEVICES 2 AND 4 | | PORTABLE |
| DEVICE 2 (WALLET) | DEVICES 1 AND 3 | DEVICES 1 AND 4 | | PORTABLE |
| DEVICE 3 (OFFICE PHONE) | DEVICES 1 AND 2 | | | FIXED |
| DEVICE 4 (ALARM CLOCK) | | DEVICES 1 AND 2 | | FIXED |
| DEVICE 5 (LEFT GLOVE) | DEVICES 3 AND 6 | DEVICES 4 AND 6 | DEVICE 6 | PORTABLE |
| DEVICE 6 (RIGHT GLOVE) | DEVICES 3 AND 5 | DEVICES 4 AND 5 | DEVICE 5 | PORTABLE |
| ... | ... | ... | | ... |
| DEVICE N | ... | ... | | ... |

SELF-DETECTION OF LOST DEVICE STATUS USING DEVICE-TO-DEVICE COMMUNICATIONS WITH ONE OR MORE EXPECTED NEIGHBORING DEVICES

FIELD OF THE INVENTION

The present invention relates generally to the electrical, electronic and computer arts, and, more particularly, to techniques for detecting when a device is lost.

BACKGROUND OF THE INVENTION

Devices are often lost or misplaced. Many devices, such as keys, television remote controls and cordless phones have a place where the device is typically kept, at particular times of day. Some devices may come with a base station (e.g., in the case of a telephone) that can be used to force the missing device, if within range, to emit a distinctive sound so that the device can be found. Such a system will fail, however, in the event that the lost device is sufficiently far away that it is outside the range of the base station or the sound generated by the lost device cannot be heard by a person in the vicinity of the base station.

A number of techniques have been proposed or suggested to assist a user with locating a lost or misplaced item. For example, the user may be required to clap or whistle to acoustically signal a locator device to provide a notification of the location of the item. Other systems employ a transmitting device that communicates a wireless signal to a receiving/locator device, which then responds with a visual or aural indication that the transmitted signal has been received. Such a system, however, requires the user to keep track of yet another object, i.e., the transmitter used in the locator system.

Key Finders, for example, are small electronic devices used to recover misplaced or lost sets of keys. Key Finders aim to reduce the time it takes to locate keys or other personal items without being obtrusive. For example, the key finders may emit a sound on-demand or otherwise guide a user towards the lost item.

Nonetheless, a need remains for a device to be able to determine for itself that it has become lost or misplaced and to provide an appropriate notification to an owner of its lost or misplaced status.

SUMMARY OF THE INVENTION

Generally, methods and apparatus are provided for self-detection of lost device status using device-to-device communications with one or more expected neighboring devices. According to one aspect of the invention, a device can detect when the device itself is lost, by determining one or more expected neighboring devices for one or more time periods; monitoring a local environment for one or more of the expected neighboring devices using device-to-device communication; detecting when the device is lost based on device-to-device communication and whether a threshold criteria of the expected neighboring devices in proximity to the device for a given interval of time; and sending at least one relay message to notify an owner of the lost device. The expected neighboring devices can be stored, for example, by the device in a file.

In one embodiment, the threshold criteria comprises whether a minimum number of expected neighboring devices are nearby or whether at least one fixed neighboring device is nearby, as can be ascertained by whether the device detecting whether it is lost can hear the broadcasts of this minimum number of neighbors or at least one fixed neighbor. As used herein, a device is said to be "fixed" if it is declared to be non-movable. The threshold criteria optionally further comprises whether any required paired devices are nearby. As used herein, two or more devices are said to be "paired" when the two devices are required at all times to be in proximity with one another. In another embodiment, the threshold criteria comprises a minimum number of the expected neighboring devices within proximity of the device or a minimum percentage of the expected neighboring devices within proximity of the device.

The device-to-device communications employ one or more of short range relay communications and low-power mesh communications. The relay notification messages to notify an owner of the lost device status can be sent from device-to-device until a device is reached that can send the notification to the owner.

A more complete understanding of the present invention, as well as further features and advantages of the present invention, will be obtained by reference to the following detailed description and drawings.

BRIEF DESCRIPTION OF THE DRAWINGS

FIG. 2 is a sample table of an expected neighbor database incorporating aspects of the invention;

DETAILED DESCRIPTION OF PREFERRED EMBODIMENTS

Aspects of the present invention provide techniques for a device to be able to determine for itself that it has become lost or misplaced and to provide an appropriate notification to an owner of its lost or misplaced status.

Generally, the lost device should detect that it is lost and notify the user/owner of the lost status potentially before the user/owner has realized that the device is lost. For example, if an owner is running late for an appointment and then realizes that the car keys are missing, it is better for the keys to have notified the owner of the lost status than for the owner to have to start looking for them.

Figure 1:
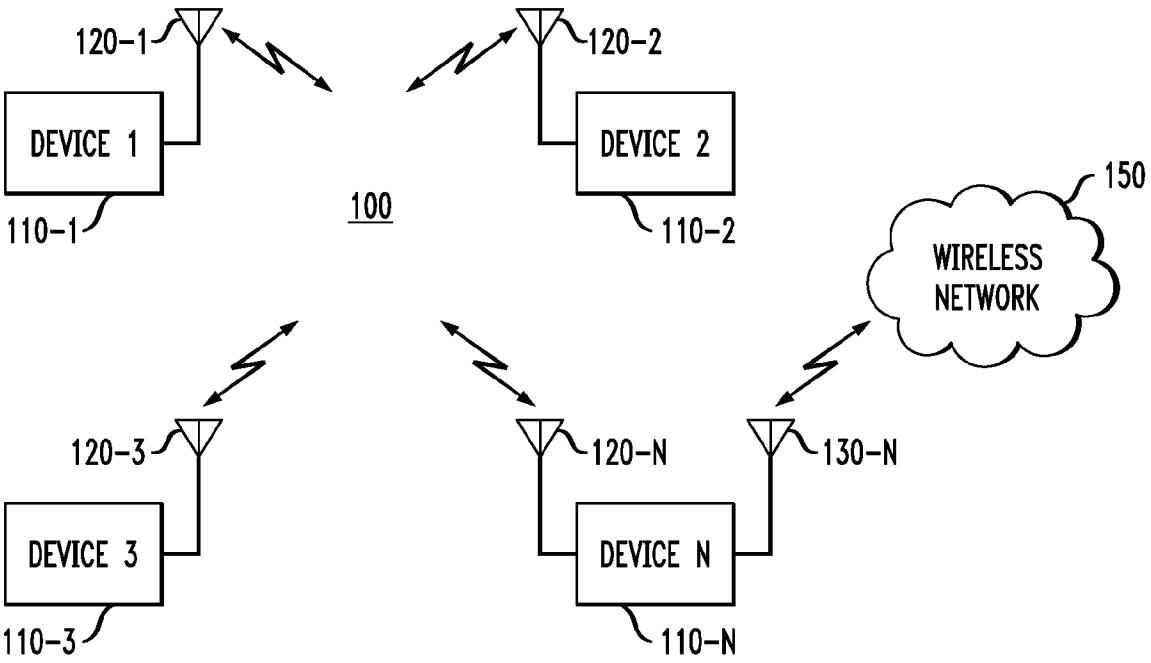
FIG. 1 illustrates an exemplary network environment in which the present invention may be employed.

FIG. 1 illustrates an exemplary network environment 100 in which the present invention may be employed. As shown in FIG. 1, one or more devices 110-1 through 110-N communicate with one another over a short range relay or low-power mesh network where devices can communicate with one another at close range. For example, the devices may each comprise an antenna 120-1 through 120-N to enable short range communications, such as those currently available through Bluetooth, infrared wireless, ultra-wideband, and induction wireless. See e.g., http://www.ehow.com/list_7361719_bluetooth-alternatives.html.

In this manner, messages can be passed from one device to another device. In addition, the devices 110 are able to broadcast, for example, a device type and a unique identifier, e.g., so that devices 110 can identify themselves to their neighbors.

As discussed further below in conjunction with FIG. 3, a device 110 can, over time, learn its expected neighbors at various times-of-day. As discussed further below in conjunction with FIG. 4, upon detecting a statistically meaningful change from the expected environment, a device 110 can send a signal to the owner of the device 110 of the lost status, such as an electronic mail message, text message and/or telephone call. Thus, one or more of the devices 110, such as device 110-N, includes an additional communication capability, so that such devices 110 can communicate with the owner of the device. For example, as shown in FIG. 1, the device 110-N includes an additional antenna 130 for wireless communications over a wireless network 150, in a known manner. In a further variation, the device 110-N includes a mechanism for wired communications over a wired network (not shown), in a known manner.

Figure 1A:
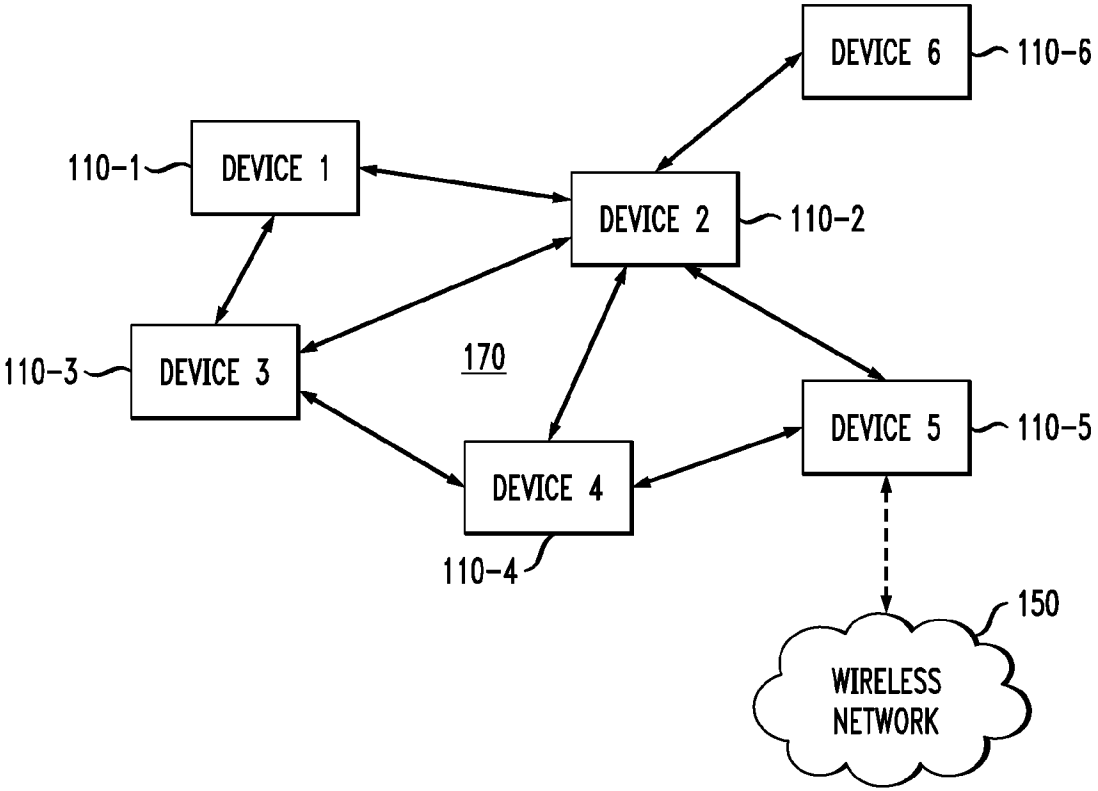
FIG. 1A shows a sample connectivity graph for an exemplary set of six devices.

FIG. 1A shows a sample connectivity graph 170 for a set of six devices 110-2 through 110-6. Arrows are drawn between devices 110 that are in close enough proximity with one another that they are capable of directly communicating with one another. If, say, Device 110-1 recognizes that it is lost, this message can be relayed via Device 110-2 and then via Device 110-5 to the external wireless network 150, with a message ultimately being passed to the device owner.

Among other benefits, aspects of the present invention provide distributed self-detection of whether a given device is lost or misplaced.

FIG. 2 is a sample table of an exemplary expected neighbor database 200 incorporating aspects of the invention. As shown in FIG. 2, the expected neighbor database 200 comprises a plurality of records, each associated with a different device. For each device identified by a device identifier in field 210, the exemplary expected neighbor database 200 identifies the daytime neighbors in field 220 and the evening neighbors in field 230. In addition, the exemplary expected neighbor database 200 optionally identifies any specified paired device(s) in field 240 and optionally whether the associated device has a fixed or portable location in field 250.

Figure 3:
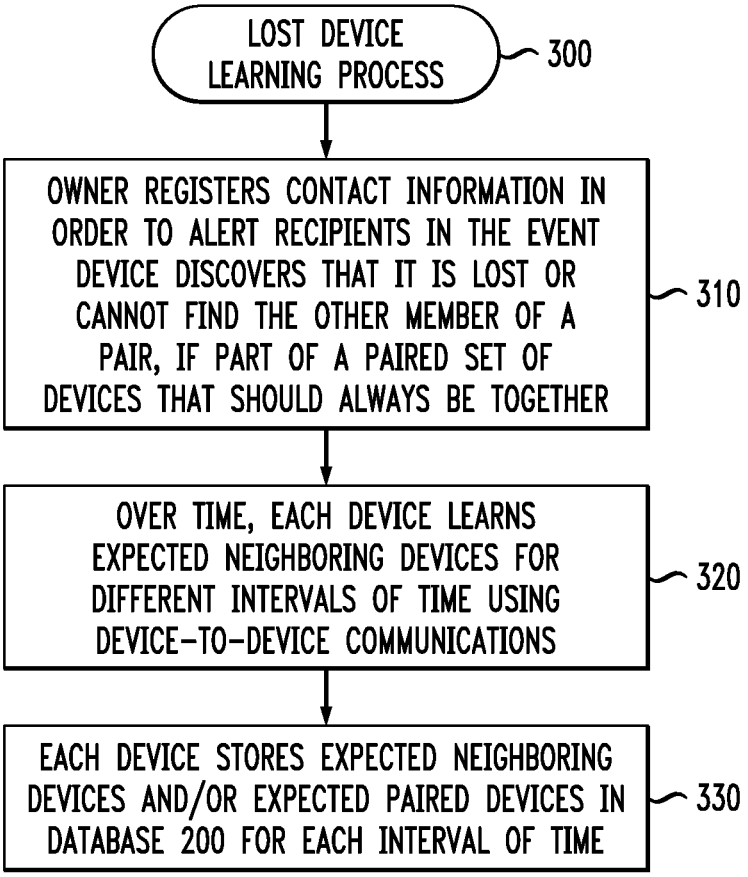
FIG. 3 is a flow chart describing an exemplary implementation of a lost item learning process incorporating aspects of the invention.

FIG. 3 is a flow chart describing an exemplary implementation of a lost device learning process 300 incorporating aspects of the invention. As shown in FIG. 3, the exemplary lost device learning process 300 initially receives an owner's registration of contact information for a given device 110, said contact information being used to alert recipients in the event of lost device(s) and, optionally, the discovery that the other member of a declared paired device is not present during step 310.

Over time, each device 110 learns expected neighboring devices 110 for different intervals of time (such as daytime and nighttime, or with a finer granularity) using device-to-device communications during step 320.

Each device 110 then stores the identified expected neighboring devices and/or expected paired devices in database 200 for each interval of time, during step 330. Program control then terminates.

Figure 4:
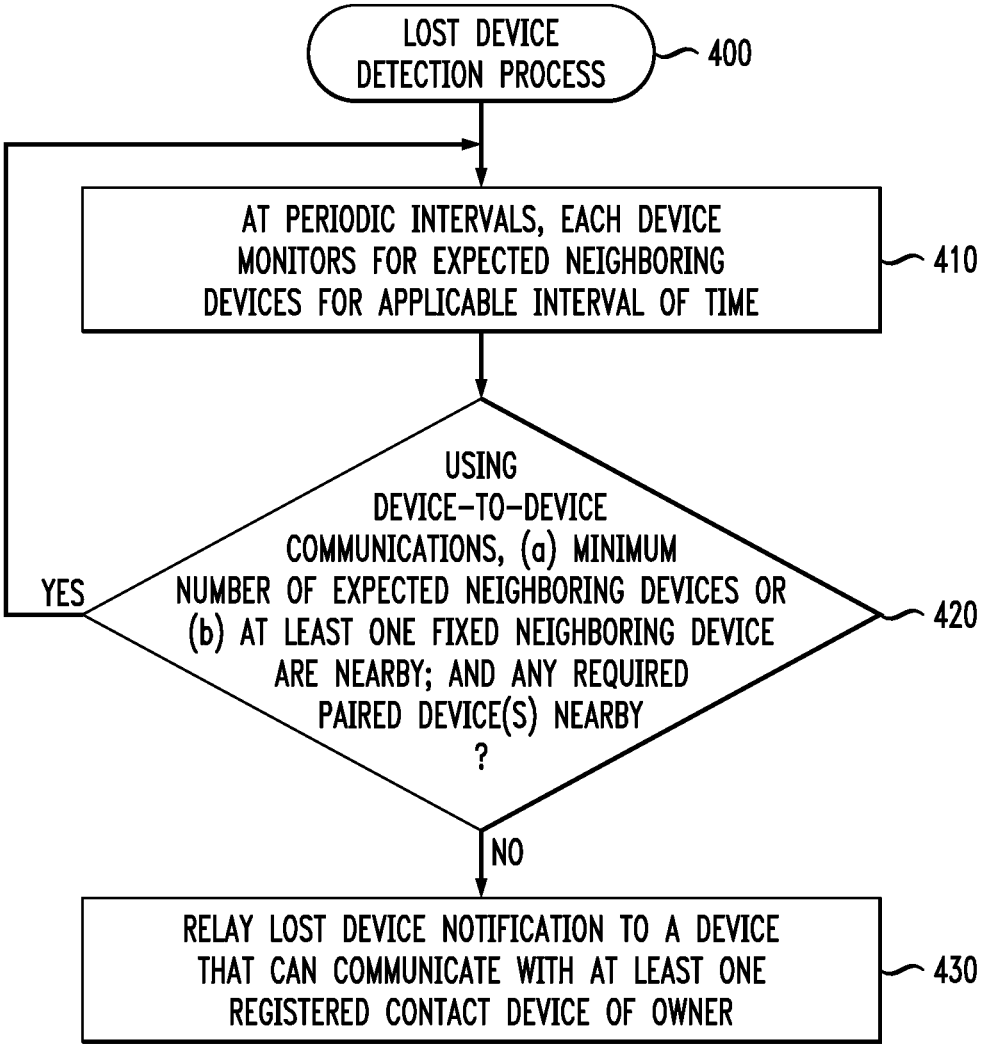
FIG. 4 is a flow chart describing an exemplary implementation of a lost item detection process incorporating aspects of the invention.

FIG. 4 is a flow chart describing an exemplary implementation of a lost device detection process 400 incorporating aspects of the invention. As shown in FIG. 4, the exemplary lost device detection process 400 for each device initially monitors, at periodic intervals, for expected neighboring devices 110 for the applicable interval of time during step 410.

The exemplary lost device detection process 400 uses device-to-device communications during step 420 to determine whether (a) a minimum number of expected neighboring devices are nearby, or (b) at least one fixed neighboring device is nearby; and whether any required paired device(s) are nearby.

If it is determined during step 420 that the above threshold criteria for expected neighboring devices is satisfied, then program control returns to step 410 and continues to monitor for a violation of the above threshold criteria for expected neighboring devices.

If it is determined during step 420 that the above threshold criteria for expected neighboring devices is not satisfied, then the exemplary lost device detection process 400 on the lost device 110 initiates a relay of a lost device notification to a device 110, such as device 110-N, that can communicate with at least one registered contact device of owner during step 430, for example, using network 150.

In a further variation, if some devices are placed in the different place (not the usual place) on purpose (for example, the TV and the remote control are moved to another room), the remote control is not with the original neighbors any more. The lost device notification is sent to the owner. If the user (owner) ignores the notification for a certain number of days, the system accepts this new change. The threshold for the number of days can be configured by the owner.

Exemplary System and Article of Manufacture Details

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

One or more embodiments of the invention, or elements thereof, can be implemented in the form of an apparatus including a memory and at least one processor that is coupled to the memory and operative to perform exemplary method steps.

Figure 5:
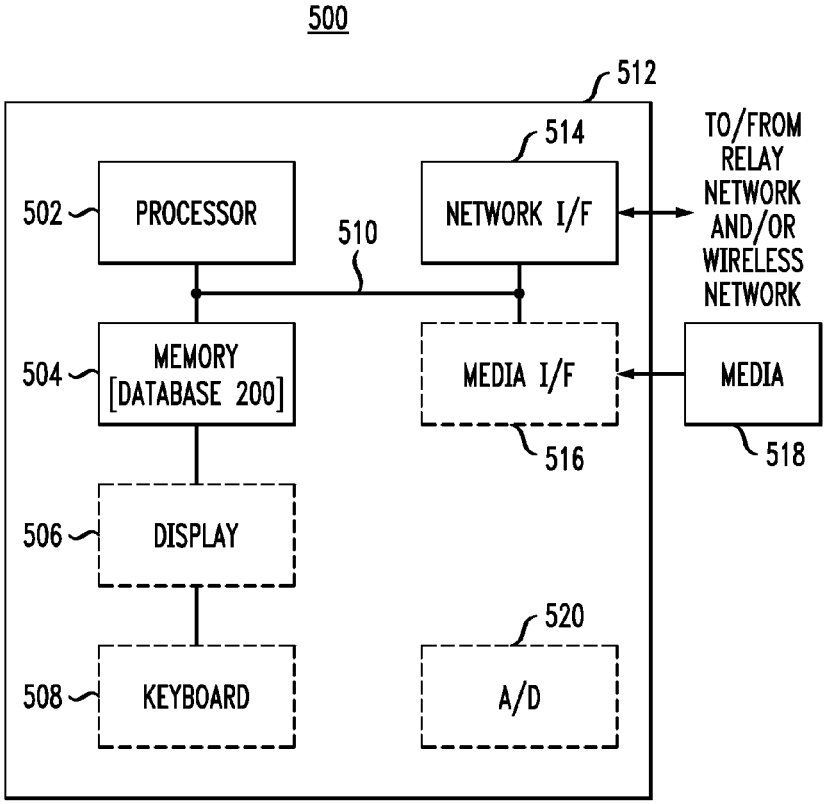
FIG. 5 depicts an exemplary lost item detection system that may be useful in implementing one or more aspects and/or elements of the present invention.

One or more embodiments can make use of software running on a general purpose computer or workstation. FIG. 5 depicts an exemplary lost item detection system 500 that may be useful in implementing one or more aspects and/or elements of the present invention. With reference to FIG. 5, such an implementation might employ, for example, a processor 502, a memory 504, and an input/output interface formed, for example, by a display 506 and a keyboard 508. The memory 504 may store, for example, code for implementing the layout process 300 of FIG. 3.

The term "processor" as used herein is intended to include any processing device, such as, for example, one that includes a CPU (central processing unit) and/or other forms of processing circuitry. Further, the term "processor" may refer to more than one individual processor. The term "memory" is intended to include memory associated with a processor or CPU, such as, for example, RAM (random access memory), ROM (read only memory), a fixed memory device (for example, hard drive), a removable memory device (for example, diskette), a flash memory and the like.

In addition, the phrase "input/output interface" as used herein, is intended to include, for example, one or more mechanisms for inputting data to the processing unit (for example, mouse), and one or more mechanisms for providing results associated with the processing unit (for example, printer). The processor 502, memory 504, and input/output interface such as display 506 and keyboard 508 can be interconnected, for example, via bus 510 as part of a data processing unit 512. Suitable interconnections, for example via bus 510, can also be provided to a network interface 514, such as a network card, which can be provided to interface with a computer network, and to a media interface 516, such as a diskette or CD-ROM drive, which can be provided to interface with media 518.

Analog-to-digital converter(s) 520 may be provided to receive analog input, such as analog video feed, and to digitize same. Such converter(s) may be interconnected with system bus 510.

Accordingly, computer software including instructions or code for performing the methodologies of the invention, as described herein, may be stored in one or more of the associated memory devices (for example, ROM, fixed or removable memory) and, when ready to be utilized, loaded in part or in whole (for example, into RAM) and implemented by a CPU. Such software could include, but is not limited to, firmware, resident software, microcode, and the like.

A data processing system suitable for storing and/or executing program code will include at least one processor 502 coupled directly or indirectly to memory elements 504 through a system bus 510. The memory elements can include local memory employed during actual implementation of the program code, bulk storage, and cache memories which provide temporary storage of at least some program code in order to reduce the number of times code must be retrieved from bulk storage during implementation.

Input/output or I/O devices (including but not limited to keyboards 508, displays 506, pointing devices, and the like) can be coupled to the system either directly (such as via bus 510) or through intervening I/O controllers (omitted for clarity).

Network adapters such as network interface 514 may also be coupled to the system to enable the data processing system to become coupled to other data processing systems or remote printers or storage devices through intervening private or public networks. Modems, cable modem and Ethernet cards are just a few of the currently available types of network adapters.

As used herein, including the claims, a "server" includes a physical data processing system (for example, system 512 as shown in FIG. 5) running a server program. It will be understood that such a physical server may or may not include a display and keyboard.

As noted, aspects of the present invention may take the form of a computer program product embodied in one or more computer readable medium(s) having computer readable program code embodied thereon. Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Media block 518 is a non-limiting example. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the FIGS. illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Method steps described herein may be tied, for example, to a general purpose computer programmed to carry out such steps, or to hardware for carrying out such steps, as described herein. Further, method steps described herein, including, for example, obtaining data streams and encoding the streams, may also be tied to physical sensors, such as cameras or microphones, from whence the data streams are obtained.

It should be noted that any of the methods described herein can include an additional step of providing a system comprising distinct software modules embodied on a computer readable storage medium. The method steps can then be carried out using the distinct software modules and/or sub-modules of the system, as described above, executing on one or more hardware processors 502. In some cases, specialized hardware may be employed to implement one or more of the functions described here. Further, a computer program product can include a computer-readable storage medium with code adapted to be implemented to carry out one or more method steps described herein, including the provision of the system with the distinct software modules. In any case, it should be understood that the components illustrated herein may be implemented in various forms of hardware, software, or combinations thereof; for example, application specific integrated circuit(s) (ASICS), functional circuitry, one or more appropriately programmed general purpose digital computers with associated memory, and the like. Given the teachings of the invention provided herein, one of ordinary skill in the related art will be able to contemplate other implementations of the components of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method performed by a device for detecting when said device is lost, comprising:

determining one or more expected neighboring devices for one or more time periods;

monitoring a local environment to recognize one or more of said expected neighboring devices using device-to-device communication;

detecting, by said device, when said device is lost based on said device-to-device communication and whether a threshold criteria of said expected neighboring devices in proximity to said device is satisfied for a given interval of time; and sending at least one relay message from said device to provide a notification of said lost device.

2. The method of claim 1, wherein the step of determining one or more expected neighboring devices for one or more time periods is determined by a learning process, such that the neighbors of the given device over time are recorded, and the device itself recognizes when certain neighbors are detected with high statistical likelihood at specified daily time periods.

3. The method of claim 1, further comprising the step of storing said expected neighboring devices in one or more of a file and another form of non-volatile storage.

4. The method of claim 1, wherein said threshold criteria comprises whether a minimum number of said expected neighboring devices are nearby, or whether at least one fixed neighboring device is nearby, as can be ascertained by whether the device detecting whether it is lost can detect the broadcasts of this minimum number of neighbors or at least one fixed neighbor.

5. The method of claim 4, wherein said threshold criteria further comprises whether any required device paired to the given device is nearby.

6. The method of claim 1, wherein said device-to-device communications employ one or more of short range relay communications and low-power mesh communications.

7. The method of claim 1, wherein said step of sending at least one relay message to notify an owner of said lost device further comprises the step of sending at least one device-to-device communication until a device is reached that can send said notification to said owner.

8. A method performed by a device for detecting when said device is lost, comprising:

determining one or more expected neighboring devices for one or more time periods;

monitoring a local environment for one or more of said expected neighboring devices using device-to-device communication;

detecting, by said device, when said device is lost based on said device-to-device communication and whether a threshold criteria of said expected neighboring devices in proximity to said device is satisfied for a given interval of time; and sending at least one relay message from said device to provide a notification of said lost device, wherein said threshold criteria comprises a minimum number of said expected neighboring devices within proximity of said device.

9. A method performed by a device for detecting when said device is lost, comprising:

determining one or more expected neighboring devices for one or more time periods;

monitoring a local environment for one or more of said expected neighboring devices using device-to-device communication;

detecting, by said device, when said device is lost based on said device-to-device communication and whether a threshold criteria of said expected neighboring devices in proximity to said device is satisfied for a given interval of time; and sending at least one relay message from said device to provide a notification of said lost device, wherein said threshold criteria comprises a minimum percentage of said expected neighboring devices within proximity of said device.

* * * * *